United States Patent [19]

Acquaviva

[11] Patent Number: 4,684,241

[45] **Date of Patent: * Aug. 4, 1987**

[54] PLURAL IMAGE DOCUMENT SET COPYING

[75] Inventor: Thomas Acquaviva, Penfield, N.Y.

[73] Assignee: Xerox Corporation, Stamford, Conn.

[ * ] Notice: The portion of the term of this patent subsequent to Feb. 4, 2003 has been disclaimed.

[21] Appl. No.: 797,288

[22] Filed: Dec. 16, 1985

Related U.S. Application Data

[62] Division of Ser. No. 541,612, Oct. 13, 1983, Pat. No. 4,568,172.

[51] Int. Cl.[4] ..... G03G 21/00

[52] U.S. Cl. ..... 355/14 SH

[58] Field of Search ..... 355/3 R, 3 SH, 14 R, 355/14 SH, 24, 46, 77

[56] References Cited

U.S. PATENT DOCUMENTS

| | | | |
|---|---|---|---|
| 4,017,173 | 4/1977 | Komori et al. | 355/26 X |
| 4,134,672 | 1/1979 | Burlew et al. | 355/14 SH |
| 4,568,172 | 2/1986 | Acquaviva | 355/14 SH |

*Primary Examiner*—Fred L. Braun

[57] ABSTRACT

A method of more efficiently copying with a copier with a recirculating document handler for making plural precollated plural sheet copy sets from a set of plural document sheets being plurally recirculated; wherein the set of document sheets being recirculated has at least two document page images per document sheet side, producing copy sheets with at least two images per side from these document sheets, and the copier control is selectably modified to separate the copy sheets into at least two separate sub-sets of output copy sets having a number of sheets corresponding to the number of document page images per document sheet side, with the number of copy sub-sets being at least twice the number of the document sheets being recirculated in the document handler, and separately binding the output copy sets into the separated collated sub-sets in response to the modification of the control means with automatic on-line binding; including known, conventional, on-line paper slitting or cutting of the copy sheets for the separating of the copy sheets into the separate sub-sets.

2 Claims, 1 Drawing Figure

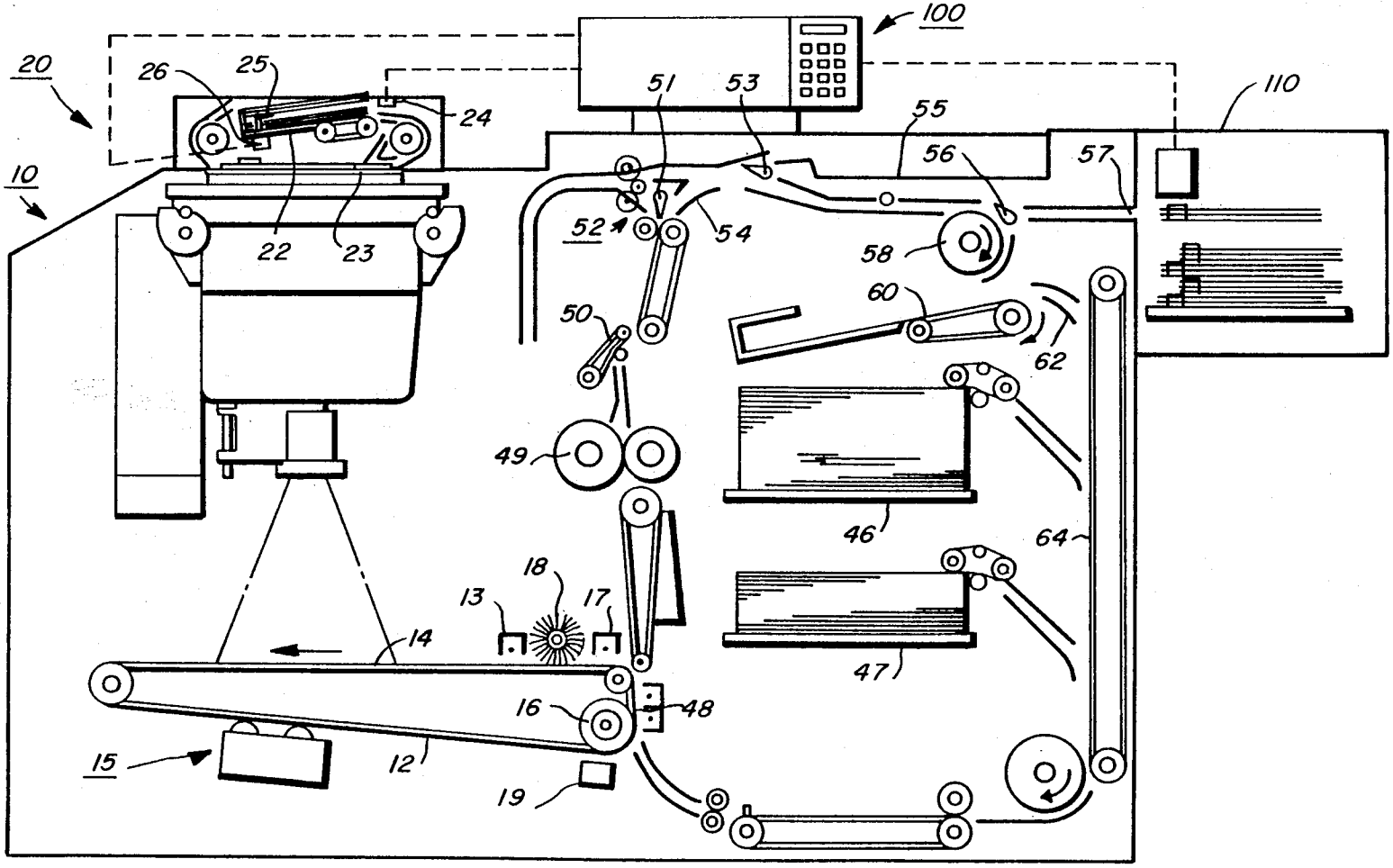
110
100
57
55
56
58
60
62
64
46
47
53
54
51
52
50
49
48
17
18
13
16
19
24
23
22
25
26
14
12
15
20
10

PLURAL IMAGE DOCUMENT SET COPYING

This is a division of application Ser. No. 541,612, filed Oct. 13, 1983.

The present invention relates to improving the efficiency of recirculatory precollation copying of small sets of original document sheets onto collated sets of copy sheets.

The method and apparatus disclosed herein may be used to improve the effective copying rate of precollation copying systems such as the exemplary copier and document recirculating apparatus and methods disclosed in U.S. Pat. No. 4,278,344 issued July 14, 1981 to Ravi B. Sahay, U.S. Pat. No. 4,330,197 issued May 18, 1982 to Richard E. Smith et al. and U.S. patent applications Ser. Nos. 448,654 and 448,655, filed Dec. 10, 1982 by Susan J. Pels, solely and with Donald W. Schaeffer, respectively; all with this same assignee. An advantage of the present system is that it may be used with such apparatus and systems without substantial structural modification. However, the present system is not limited thereto and is usable with various other present or future recirculative document handlers and copiers. The latter two cited applications are also of particular interest as also directed to the subject problem of more efficient copying of small document sets, particularly for larger numbers of copy sets made therefrom.

As xerographic and other copiers increase in speed, and become more automatic, it is increasingly important to provide higher speed yet more reliable and more automatic handling of both the copy sheets and the original documents being copied, i.e. both the output and input of the copier. However, the providing of recirculative document copying for precollation copying, especially for duplex (two-sided) copies, greatly complicates and increases the document sheet and copy sheet handling complexities.

In the description herein, the term "sheet" generally refers to conventional sized flimsy sheets of paper, plastic, or other conventional or typical individual image substrates (original or copy), and not to microfilm or electronic images which are generally much easier to manipulate. The term "page" here normally refers to one side or "face" of a sheet or a corresponding image thereof. A "simplex" document or copy sheet is one having its page and image on only one side or face of the sheet, whereas a "duplex" document or copy sheet has pages on both sides. The term "duplex copying" may be more specifically defined into several different known copying modes. In "duplex/duplex" copying, both sides (both pages) of a duplex document sheet are copied onto both sides of a copy sheet. In "simplex/duplex" copying, the two page images of two successive simplex document sheets are copied onto the opposite sides of a single (duplex) copy sheet. In "duplex/simplex" copying, both sides of a duplex document are copied onto one side of two successive (simplex) copy sheets. In non-duplex copying, i.e. "simplex/simplex" copying, one side of each simplex document is copied onto one side of each copy sheet. The present system may be used with any and all of these modes.

"RDH" is an abbreviation for an automatic recirculating document handler, in which document sheets are automatically fed from a stack, copied and returned thereto, normally for a precollation copying system. The present system is particularly suited for a precollation (multiply recirculated) document copying system, but is also compatible with non-precollation copying with the same apparatus.

Precollation, or collation copying, as it is variably called, is a known desirable feature for a copier, which provides a number of important advantages. In precollation copying any desired number of precollated copy sets may be made by making a corresponding number of recirculations of the original document set in collated order past the copier imaging station and normally copying each document page only once or twice each time it circulates past the imaging station. The copies automatically exit the copier in precollated sets, and thus do not require subsequent sorting in a sorter or collator. Proofing and on-line finishing and/or removal of any completed copy sets may thus be provided while further copy sets are being made from the subsequent circulations of the same document set.

However, a disadvantage of precollation copying systems is that the set of documents must be recirculated and copied in a predetermined seriatim page order by a number of set circulations equivalent to the desired number of copy sets. Thus, increased document handling is required for a precollation copying system as compared to a post-collation copying system. Also, for duplex copying the copy sheets must normally also be recirculated once in the copying path in coordination with the document set recirculation in order to print images on both sides thereof. Therefore, maximizing document handling automation and copying cycle efficiency is particularly important in precollation copying. If the document handler cannot efficiently and rapidly circulate and copy documents in coordination with copy sheets in the correct order, or must excessively skip documents or copying cycles, the total copying time for completing all of the copy sets will be increased. Also, for collation copying, minimizing the time delay from the initiation of copying until the first copy set is completed and outputted is another important factor. This may be referred to as "first copy set out time".

These all create particular time delay problems for small document sets, i.e., those having a small number of document sheets. Such small sets may require skipping a number of copier pitches in each circulation of the small document set.

In contrast, in a post-collation copying system, several identical copies are made at one time from each document page. Collation must be done after copying by each identical copy being placed in a different sorter bin. The document set need only normally be circulated or manually or semi-automatically fed to the imaging station once. Thus, at the end of the document set circulation each utilized bin of the copy sheet sorter or collator contains one collated copy set. However, the number of copy sets which can be made in one document circulation is limited by the number of available sorter bins. Also, a sorter adds space and complexity and is not well suited for on-line finishing. Further, the "first copy set out time" for any completed sets is delayed for the copying and collating of all the other sets of that copying run. However, post-collation copying, or manual document placement, are desirable in certain copying situations to minimize document handling. Also post-collation can employ slower document handling in that the copying rate is not limited by any document exchange times during the times the plural copies are being made. Thus, it is desirable in some cases that a precollation copying system be compatible with, and alternatively usable for, post-collation or manual document handling as well.

Both forward serial order (1 to N) and reverse order (N to 1) precollation copying of original documents, for both simplex (one-sided) and duplex (two-sided) original documents and copies, is shown in the cited art. Examples of 1 to N, normal, or forward serial order, document recirculation systems for precollation simplex or duplex copying systems are disclosed in U.S. Pat. Nos. 4,229,101 to T. J. Hamlin et al., 4,234,180 to J. H. Looney, and 4,355,880 to D. J. Stemmle, and art cited therein.

However, N to 1 (reverse order) document set circulation is commercially more conventional for systems feeding documents from a tray positioned over a platen of a copier, as in the above-cited systems. In such conventional systems the set of documents is loaded (stacked) face-up, and each document sheet is fed out from the bottom of the stack, copied, and restacked back on the top of the stack. Thus the simplex documents are circulated in an endless loop by being turned over, copied, turned over again, and returned back to the top of the stack over the platen. Conventionally, N to 1 simplex/duplex copying requires precounting of the entire simplex document set before copying (i.e. with an initial non-copying circulation) and/or selective use of a copy sheet inverter in the copy sheet path, with various disadvantages, as explained more fully in the above-cited patents. Duplex documents require inversion, as taught in various art cited herein.

N to 1 document recirculation has been commercially utilized in spite of known disadvantages because bottom feeding and top restacking is generally preferred for a preferred "racetrack" document circulation path. The documents may be recirculated in a short over-platen loop to and from a document stack located over the copier platen, and the entire RDH may be in a pivotal platen cover unit. Documents can be fed from one edge of the stack to the same side or edge of the platen underneath the stack, and then back from the opposite edge of the platen to the opposite edge of the stack. The documents may be stream fed unidirectionally over the platen. One document may be fed on while the prior document is feeding off. The document path has a short 180° loop turn above each side of the platen. With a shorter and unidirectional document recirculation path, document transport speeds can be lower and/or the number of copy pitches skipped in copying small document sets can be reduced.

Even in a "racetrack" RDH there is a minimum number of document sheets, e.g. 4, which must be in the recirculation path of that particular RDH to maintain continuous circulation at the full rate of the copier without waits or skips, even for simplex copies. This may be one or two sheets higher for duplex documents. There may also be a higher minimum number of document sheets which must be in recirculation by the RDH for fully efficient duplex copying due to the above-noted copy sheet circulation path requirements of many duplexing systems.

Another form of collated duplex copying system usable with the present system is disclosed, for example, in U.S. Pat. No. 4,095,979 issued June 20, 1978 to A. B. DiFrancesco et al. In the latter type of duplexing system each copy sheet (and each duplex document) is turned over immediately for its second side image. This system also has a minimum document set size for full efficiency.

Some examples of further details of some suitable N to 1 or racetrack type recirculating document handlers are disclosed in U.S. Pat. Nos. 4,335,954 issuing June 22, 1982 to Russell L. Phelps; 4,270,746 issued June 2, 1981 to T. J. Hamlin; 4,324,395 issued Apr. 13, 1982 to Morton Silverberg and 4,076,408 issued Feb. 28, 1978 to M. G. Reid, et al.; and Xerox Corporation EPO Application Publication No. 0 079 224 published May 18, 1983. Further suitable exemplary RDH details are in the following disclosures: U.S. Ser. No. 373,919 filed May 3, 1982 (D/82035) (on a set separator/stack height sensor) and art cited therein; and U.S. Ser. Nos. 317,211, 317,212 and 317,219, all filed Nov. 2, 1981 by, respectively, John M. Browne (D/81079 and D/81077) and Gerald M. Garavuso (D/80277) (on document sheet acquisition and initial feeding from the bottom of an RDH document tray) all by the same assignee.

U.S. Pat. No. 4,078,787 issued Mar. 14, 1978 to L. E. Burlew et al. is noted as to conventionally plurally copying a single simplex document, in an RDH without any circulation, since single page, single sheet, copy sets cannot, of course, be collated. Also noted is U.S. Pat. No. 4,093,372 issued June 6, 1978 to Joachim Guenther, teaching an RDH copying system which switches from a precollation to a post-collation mode of copying automatically in response to operator selection of a preset (large) number of desired copy sets.

A brief anonymous Disclosure Number 19015 at page 61 of the "Research Disclosure" published February, 1980 by Industrial Opportunities, Ltd., Homewell, Havant, Hampshire, U.K. is noted for suggesting that when duplex original documents are being recirculatively copied onto duplex copy sheets (in a copying system where the duplex documents must be immediately inverted each time for copying opposite sides in immediate sequence) that the consequent copying speed loss can be compensated for to some extent by making two consecutive copies of the same original each time. However, it requires 2 copy receiver trays.

Even further details for the exemplary copier shown herein are disclosed in the following pending U.S. patent applications and foreign equivalents thereof: Ser. No. 372,581 filed Apr. 28, 1982 re optics (D/80268); Ser. Nos. 420,965 (D/82127); 420,993 (D/82157) and 421,006 (D/82149) re controls, all filed Sept. 21, 1982; Ser. No. 420,966 filed Sept. 20, 1982 re copy sheet feeders; and Ser. No. 193,228 filed Oct. 2, 1980 (D/80151) and Ser. No. 443,799 filed Nov. 22, 1982 (D/82194) [and U.S. Pat. No. 3,856,295 issued Dec. 24, 1974 to J. H. Looney] re copy sheet inverters. Another inverter is shown in IBM Technical Disclosure Bulletin Vol. 18, No. 1, June 1975, p. 40.

Some examples of automatic on-line collating copier finishers (staplers, stichers, gluers or other binders) and/or offsetters and their controls which may be utilized with this invention are disclosed in U.S. Pat. Nos. 3,630,607 issued Dec. 28, 1971 to H. Korn et al.; 3,793,016 issued Feb. 19, 1974 to R. N. Eichorn; 4,134,672 issued Jan. 16, 1979 to L. B. Burlew et al.; 4,328,919 issued May 11, 1982 to B. R. Lawrence et al.; 4,344,544 issued Aug. 17, 1982 to T. Cross; 4,398,986 issued Aug. 16, 1983 to Robert C. Smith et al.; and EPO Publication No. 0 013 164 published July 9, 1980 (D/78001) and the "Research Disclosure Journal" publications Nos. 22733 and 22734 on pages 120–134 of the March 1983 issue (anonymous) and their corresponding patent applications. Another copier on-line glue binder is disclosed in Xerox Disclosure Journal Vol. 4, No. 4, p. 425 July 1979. These may all be used with the present invention simply by changing the activation times and activation rates as described herein for their compiler or accumulator binding operations. However, the present invention is not limited to any particular type of finishing or apparatus therefor.

The use of a copy set as a document set in an RDH is taught in U.S. Pat. No. 4,391,504 issued July 5, 1983 to (the same) T. Acquaviva and references cited thereon.

Examples of various other patents teaching known document handlers and copiers and control systems therefor, including document and paper path switches and counters, are U.S. Pat. Nos.: 4,054,380; 4,062,061; 4,076,408; 4,078,787; 4,099,860; 4,125,325; 4,132,401; 4,310,235; 4,144,550; 4,158,500; 4,176,945; 4,179,215; 4,229,101; 4,278,344; 4,284,270 and 4,335,949. Conventional simple software instructions in a copier's conventional microprocessor logic circuitry and software of document handler and copier control functions and logic, as taught by the above and other patents and various commercial copiers, are well known and preferred. However, it will be appreciated that the document handling and other functions and controls described herein may be alternatively conventionally incorporated into a copier utilizing any other suitable or known simple software or hard wired logic systems, switch controllers, etc. Such software for functions described herein may vary depending on the particular microprocessor or microcomputer system utilized, of course, but will be already available to or readily programmable by those skilled in the art without experimentation from the descriptions and references provided herein.

The control of the exemplary document and copy sheet handling systems disclosed herein may be accomplished by conventionally activating them by signals from the controller direct or indirectly in response to simple programmed commands and from selected activation or non-activation of conventional copier switch inputs by the copier operator, such as switches selecting the number of copies to be made in that run, selecting simplex or duplex copying, selecting whether the documents are simplex or duplex, selecting a copy sheet supply tray, etc. The resultant controller signals may conventionally actuate various conventional electrical solenoid or cam controlled sheet deflector fingers, motors or clutches in the copier in the selected steps or sequences as programmed. Conventional sheet path sensors, switches and bail bars, connected to the controller, may be utilized for counting and keeping track of the positions of documents and copy sheets, as is well known in the art, and taught in the above and other patents and products. Known precollation copying systems utilize such conventional microprocessor control circuitry and connecting switches for counting the number of document sheets as they are circulated, counting the number of completed document set circulations, and thereby controlling the operation of the document and copy sheet feeders and inverters, the offsetting and/or stapling, stitching, glueing or other finishing of completed (outputted) collated copy sets, etc.

All references cited herein, and their references, are incorporated by reference herein for appropriate teachings of additional or alternative details, features, and/or technical background.

The present invention desirably overcomes or reduces various of the above-discussed problems.

A general disclosed feature herein is to provide more efficient and rapid precollation copying with a recirculating document handling system of small sets of document sheets.

A preferred specific feature disclosed herein is to provide a method and apparatus of more efficiently copying sets of document sheets having a small number of document sheets per set on a copier with a recirculating document handler onto plural collated copy sheet sets with plural copying recirculations of all the document sheets in said recirculating document handler, comprising the steps of:

automatically commonly recirculating for copying in said same recirculating document handler a plurality of different said small document sets, and automatically separating the plural copy sheets made therefrom into separate collated sub-sets, each said copy sub-set corresponding to one of said different small document sets, and wherein the number of said sub-sets is greater than said plural number of document copying recirculations, said separation being controlled automatically in response to the number of document sheets in said commonly recirculated small document sets.

Further features which may be provided by the method and apparatus disclosed herein, individually or in combinations, include those wherein said plural different small document sets are commonly loaded into said recirculating document handler, or wherein said commonly recirculated plural different small document sets comprise an original small document set and one or more sets of collated copies of said original small document set loaded into said recirculating document handler after the initial copying circulation of said original small document set, and wherein said recirculation is automatically interrupted for said loading of said one or more copy sets before the initiation of said common recirculation thereof, or wherein the recirculation of documents in said recirculating document handler is automatically halted after the initial copying circulation of the original document set, for the loading of a copy set thereof, in response to the counting of a number of said original sheets of less than a preset number providing efficient copying, and wherein said automatically separating step comprises automatically separately offsetting and/or finishing each copy set of each of said different small document sets, and wherein said automatically separating step is automatically controlled by a count of the number of document sheets in said small sets, and wherein said counting is made automatically in said recirculating document handler by counting one said set initially recirculated therein, and wherein said automatically separating is provided by a compiler/finisher for said collated copy sheet sets, which compiler/finisher normally operates only once per copying circulation of all the documents in said recirculating document handler, but which in the method herein is automatically operated a greater number of times, corresponding to the number of said plural small sets being commonly recirculated, and wherein said compiler/finisher is so operated twice per each said common circulation of all of the document sheets in said recirculating document handler if the number of said different said small document sets being commonly recirculated is two.

A further disclosed feature comprises copying means for more efficiently copying sets of document sheets having a small number of sheets per set on a copier with a recirculating document handler onto plural collated copy sheet sets normally corresponding in number to the number of copying recirculations of the document sheets by said recirculating document handler, which recirculating document handler and copying means normally copies only a single document set at a time, comprising:

means for commonly and automatically recirculating and plurally copying in said recirculating document handler a plurality of different said small document sets, and automatically separating said copy sheets made therefrom into separate collated sub-sets of a greater number than said number of copying recirculations, each said copy sheet sub-set corresponding in its number of copy sheets to one of said different small document sets, said separation being controlled automatically in response to means indicative of the number of document sheets in at least one of said commonly recirculated small document sets, and wherein said commonly recirculated plural different small document sets may comprise an original small document set and one or more sets of collated copies of said original small document set loaded into said recirculating document handler after the initial copying circulation of said original small document set, and wherein said recirculation is automatically interrupted for said loading of said one or more copy sets before the initiation of said common recirculation by said means indicative of the number of document sheets in at least one small document set, and including means for automatically halting temporarily the recirculation of documents in said recirculating document handler after an initial counting circulation of the original document set in response to the counting of a number of said original sheets of less than a preset number providing efficient copying.

A further feature is to provide in a copier with a recirculating document handler for making plural precollated plural sheet copy sets from a plural page set of plural document sheets plurally recirculated from the document handler to the imaging station of the copier and back, with control means for counting the number of document sheets being recirculated and controlling the output of said precollated copy sets in separated said sets each normally corresponding in number to the number of recirculations of the document set and normally containing numbers of copy sheets in each set corresponding to said number of document sheets (separately offset and/or bound into said plural sheet sets) the improvement comprising:

selectable sub-set control means for selectably modifying said control means to change the number of copy sheets to be so separated into a number of separate sub-sets greater than the number of recirculations of the documents having a selected number of sheets per copy set which is less than said number of sheets of recirculated documents, and means for separating said output copy sets into said separated collated sub-sets (separately offset and/or bound, or the like) in response to said selection of said sub-set control means, and wherein said selectable sub-set control means may operate in response to operator controllable means indicative of the recirculation of plural document sets in said recirculating document handler, and wherein said selectable sub-set means is controlled by means indicative of a small document set having a number of document sheets less than a preset number providing a desired copying efficiency, and wherein said preset number is less than 10 and is selected in relation to the recirculative copying efficiency of said copier; and including means for separately binding said output copy sets into said separated collated sub-sets in response to said selection of said sub-set control means comprising automatic on-line binding means actuated to separately bind copy sub-sets corresponding to separate document sets commonly recirculated in said RDH.

Various of the above-mentioned and further features and advantages will be apparent from the examples described hereinbelow of specific apparatus and steps of operation. The invention will be better understood by reference to the following description of one specific embodiment thereof, which includes the following drawing figures (approximately to scale) wherein:

The FIGURE is a schematic cross-sectional side view of an exemplary known recirculating document handler (RDH) and integral copier and finisher with which the present invention may be practiced, with plural small document sets being commonly recirculated but with the copy sets being separately on-line finished.

The FIGURE illustrates one example of a xerographic copier 10 and its automatic recirculating document feeder unit (RDH) 20 utilizing one example of the present invention. This exemplary copier 10 and RDH 20 are shown in the above-cited U.S. Pat. No. 4,278,344 and other references except for the modifications descibed herein. It will be appreciated that this apparatus is merely one example and that various other RDH's and copiers may be utilized with the present invention such as those disclosed in other above-cited references. This particular example contains a preferred controller 100 having an operator console with a multi-message display panel capable of displaying instructions to the operator and questions for the operator to answer by making appropriate selections from programmable selectors which is on the console. Such a system is provided in, for example, the Xerox Corporation "1075" copier. Further details are illustrated in the cited references thereon. The novel operator selections and corresponding unique automatic control functions described herein are all preferable on this console of the controller 100 with software readily programmable therein.

The particular exemplary RDH 20 disclosed here is an over-platen "racetrack" type. The document sheets are initially placed by the operator face-up in normal forward collated order in the tray 22 of the RDH 20, i.e. loaded with page 1 of the document set facing up and on top. Heretofore, only one integral set of such documents was placed in the RDH and copied (1 "job" ) at one time for making collated copy sets from. That is, only one plural page document set was recirculated at a time by the RDH and copied, even if it was a small document set, i.e., a document set comprising a small number of pages. Likewise, heretofore each circulation of the document set for copying normally corresponded to the output of one collated copy set of the same size in the copier output or finisher. Thus, heretofore the finisher was actuated or operated normally once per document set circulation in the RDH either directly or indirectly by the set counter, a switch which is actuated each time a recirculation of all of the documents in the RDH is completed. (With an appropriate time delay for the outputting of the last copy sheet made from the last document in the recirculated document set).

In contrast here, as shown in the FIGURE as one example, two separate 3-sheet document sets (6 sheets total) are being commonly recirculated in the RDH 20 from the same tray 22. Yet they are being automatically separately bound (here stapled) in corresponding 3-sheet copy sets in the illustrated finisher 110 rather than bound in 6 sheet sets as would be normal and expected.

A suitable on-line finisher for a copier such as 110 illustrated, as described in the references cited above thereon, typically has an initial compiler for initially accumulating the copy sheets as they are individually outputted until there is one complete collated, copy set (heretofore corresponding to the recirculation of all the documents in the RDH). Then the finisher is normally actuated so that the stapler, stitcher, or other binder therein binds this compiled set of copies into a finished copy set, as shown. Then this finished set is removed from the compiler by, for example, a gripper and arm movement or the like known set transport apparatus into an output set stacker or second compiler, where the sets may be offset stacked, as shown, if this is selected by the operator on the controller console. This cycle is repeated until the selected number of copies (the total number of copy sets to be made) has been accummulated in this final output tray. Alternatively, glue or other binder material may be applied to the sheets individually as they are outputted and/or accummulated and then they may be successively clamped in the compiler and ejected as bound sets. In either case, the output sets may be stacked in their final output in slightly offset (staggered) positions as shown so that the separate sets may be more easily removed. A known alternative is to provide such offset stacking of the sets without actuating the finisher. This allows subsequent off-line binding of the copy sets in a different binding apparatus.

The present system is compatible with all of these, and other, binders or finishers or unbound offset stacking systems, or any other system for providing separation of the collated sets of output copies properly. That is, with the copy sets bound or finished individually with only the pages copied from one document set (plus inserted cover sheets if desired) being bound together normally. Thus, for example, for each 4-page document set the finisher should operate to bind each time the 4-page copies therefrom and any covers therefore are compiled.

The document handler 20 here has conventional switches or other sensors such as 24 for sensing and counting the individual documents fed from the tray 22, i.e. counting the number of document sheets circulated. In tray 22 a conventional resettable bail or set-separator finger 25 drops at the completion of each circulation to indicate through its associated set-counter switch or sensor 26 one circulation of all the documents in the tray 22 (i.e. sensing each time that all the documents have been fed out from under the finger 25. The finger 25 is then automatically reset on the top of the stack before the next circulation. The document feeder 20 is adapted to continually serially recirculate all the documents therein until a selected number of copy sets is made therefrom. The document sheets may be various conventional sizes and weights of sheets of paper or plastic containing information indicia to be copied on one or both sides, e.g. printed or typed letters, drawings, prints, photographs, etc. Switches 24 and 26 connect with the controller 100 to count the number of document sheets which have been fed and circulated and to control the copy output accordingly.

Although not illustrated herein, there may be additionally provided in this RDH 20 an inverter whereby each document may be selectably inverted or not inverted as it is fed from the tray 22 to the imaging station 23 or in the return to tray 22 through one of two paths selectable by the controller, a simplex document path and duplex document path. The two paths may be provided, for example, by a selectably reversible sheet drive roller (inverting roller) and a selectable position gate or deflector in the document path, as shown for example in the above-cited U.S. Pat. No. 4,278,344.

In the method of precollation copying of plural sets of plural (multi-page) document sheets to be further disclosed herein, the document sheets in this particular example are presented to the imaging station 23 of the copier 10 in N to 1 or conventional reverse serial page order. They are multiply recirculated between the stacked sets of the document sheets and the imaging station 23, and copied once (or twice) on one side per circulation at said imaging station, by feeding the document sheets seriatim from the bottom of the entire common stack to one side of said imaging station and then returning the document sheets from the opposite side of said imaging station to the top of the entire common stack, in a recirculatory loop path.

In the systems here, no hardware changes are required over prior systems. Fully compatible precollation copying may be provided with the same document handler and copier merely by providing an additional or modified program in the copier controller 100 programmer. The operator document loading steps and operator switch selections may be conventional except as described herein.

The exemplary copier 10 processor and its controller 100, disclosed in the above-cited U.S. Pat. No. 4,278,344 will now be briefly described here. The copier 10 conventionally includes a xerographic photoreceptor belt 12 and the xerographic stations acting thereon for respectively corona charging 13, image exposing 14, image developing 15, belt driving 16, precleaning discharge 17 and toner cleaning 18. A densitometer 19 control may also be provided. The copier 10 is adapted to provide duplex or simplex precollated copy sets from either duplex or simplex original documents copied from the same RDH 20. Two separate copy sheet trays 46 and 47 are provided for feeding clean copy sheets from either one selectably. They are referred to as the main tray 46 and auxiliary tray 47. The control of all sheet feeding is, conventionally, by the machine controller 100.

The controller 100 is preferably a known programmable microprocessor, exemplified by the art cited above, which conventionally also controls all of the other machine steps and functions described herein including the operation of the document feeder 20, the document and copy sheet gates, the feeder drives, etc. As further disclosed in those references, the controller 100 also conventionally provides for storage and comparison of the counts of the copy sheets, the number of documents recirculated in a document set, the desired number of copy sets and other selections by the operator through the panel of switches thereon, time delays, jam correction control, etc.

Additionally disclosed here is a connecting finisher or finishing station 110 controlled by the controller 100 to bind and/or offset collated sets of copy sheets. This normally operates one per each document set circulation as detected by switch 26, but as described herein this is changed by the present system.

The copy sheets are fed from the selected one of the trays 46 or 47 to the transfer station 48 for the conventional transfer of the xerographic toner image of a document page to the first side of a copy sheet. The copy sheets here are then fed by a vacuum transport to a roll fuser 49 for the fusing of the toner image thereon. From the fuser, the copy sheets are fed through a sheet decurler 50 to a gate or deflector fnger unit 51 which functions as an inverter selector. Depending on the position of the gate 51 the copy sheets will either be deflected into a copy sheet inverter 52 or bypass the inverter 52 and be fed directly onto a second pivotal decision gate 53. Those copy sheets which bypass the inverter 52 turn a 90° corner path 54 in the sheet path which inverts the copy sheets into a last-printed face-up orientation before reaching a second gate 53. That is, the image side which has just been transferred and fused is face-up at this point. If the inverter 52 sheet path is selected instead (by gate 51) the opposite is true (the last-printed sheet face is face-down at this point).

This second decision gate 53 then either deflects the sheets directly into an output tray 55 or deflects the sheets into a transport path which carries them on without further inversion to a third decision gate 56. If this third gate 56 is down it passes the sheets directly on without inversion into the output path 57 of the copier. If gate 56 is up it deflects the sheets into a duplex inverting transport 58. The inverting transport (roller) 58 inverts and then stacks copy sheets to be duplexed in a duplex tray 60 when the gate 58 so directs.

The duplex tray 60 provides intermediate or buffer storage for those copy sheets which have been printed on one side and on which it is desired to subsequently print an image on the opposite side thereof, i.e. copy sheets in the process of being duplexed. Due to the sheet inverting by the roller 58, these buffer set copy sheets are stacked into the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path (paper path) 64 as is provided for the clean (blank) sheets from the trays 46 or 47. It may be seen that this copy sheet feed path 64 between the duplex tray 108 and the transfer station 48 has an inherent inversion which inverts the copy sheets once. However, due to the inverting transport 58 having previously stacked these buffer sheets printed face down in the duplex tray 60, they are represented to the photoreceptor 12 at the transfer station 48 in the proper orientation, i.e. with their blank or opposite sides facing the photoreceptor 12 to receive the second side image. This is referred to as the "second pass" for the buffer set copies being duplexed. The now fully duplexed copy sheets are then fed out again through the fuser 49 to be stacked in tray 55 or fed out into the output path 57.

The output path 57 transports finished copy sheets (either simplex or duplex) to another output stacking tray or, preferably, to the on-line finishing station 110. There the completed precollated copy sets may be finished by stapling, stitching, glueing, binding, and/or offset stacking in the module 110 therefor. Suitable details are described in the finishing references previously cited above therefor.

If alternative non-precollated output is provided, as by using the RDH 20 in a known semi-automatic stream feeding mode utilizing only platen transport 30, or alternative manual document placement, then the output path 57 may alternatively connect to a sorter module. The sorter can have an inherent sheet path inversion if 1 to N order document presentation order is used.

It is desirable to minimize the operation of the copy sheet output inverter 52, in order to simplify and shorten the paper path and increase its reliability. Its use also depends on the inherent inversions provided within the paper path of the copier. The exemplary inverter 52 here operates by the gate 51 deflecting a copy sheet face-down into the first or lower nip of the illustrated three roll inverter, which drives the sheet into the inverter chute. The copy sheet's forward movement may then be stopped and reversed within the inverter chute by known or suitable sheet reversing means, e.g., further rollers as shown. The reversed copy sheet is then driven out of the inverter 52 through the second or upper nip of the same three roll inverter unit directly toward the gate 53. The curved shape of the inverter chute acting on the beam strength of the sheet causes the sheet trail edge to flip up toward this second nip. Note that the inverter 52 here is positioned at a corner of an otherwise inherent 90° paper path inversion as described above. However, any other suitable sheet inverter may be utilized, and may be provided at different positions in the copy sheet output path.

With N to 1 duplex copying here the last-printed page in each set is always page two printed on the back of the page one sheet, or vice versa, and this last duplex copy sheet is exited with page 2 down. In each completed set of copies the outputted duplex copies as picked up by the operator should be in the proper precollated page order $\frac{1}{2}$; $\frac{3}{4}$; 5/6; etc., even though they were copied in the reverse page number order, and even though odd page sides may be printed before even page sides, or vice versa, depending on the system selected.

As disclosed, for example in the above-cited Sahay U.S. Pat. No. 4,278,344, etc., a preferred simplex/duplex precollation system (for making duplex copies from simplex document sheets) for N-1 (reverse page order) copying is as follows: there is a first non-copying precount circulation by RDH 20 to count the number of simplex document sheets. Then in the second circulation (first copying circulation) of the document set only alternate document sheets (e.g., only the even pages) are copied at the imaging station 23 to make and fill duplex tray 60 with a buffer set of half-completed duplex copies. Then in all subsequent copying circulations (except the last) all of the document sheets are copied, but onto sheets fed alternately from copy tray 46 (or 47) and duplex tray 60. Those documents copied onto sheets from tray 46 or 47 are being temporarily placed in tray 60 for the next circulation (except for an Nth odd page) at the same as those documents copied onto the sheets fed out from tray 60 are being outputted as completed duplex copies. In the final document circulation only the other alternate document pages not copied in the first copying circulation are copied. They are copied onto sheets fed only from the duplex tray 60, to deplete the buffer set from duplex tray 60.

A preferred compatible duplex/duplex precollation system (for copying duplex documents onto duplex copy sheets) is also taught in said Sahay U.S. Pat. No.

4,278,344. No precount circulation is required, but the number of document sheets in the document set is counted in the first (copying) circulation. Only one side (e.g. only even page sides, of the duplex document sheets are copied in the initial circulations. The copies of this one side are stored as an intermediate buffer set in duplex tray 60. After a calculated integral number of said initial document set circulations corresponding to a desired maximum number of copies to be accumulated in said buffer set (e.g., 14 divided by the number of document sheets counted plus 1) the duplex documents are inverted during the next copying circulation, and then the other sides of the duplex documents are copied in an equal number of subsequent circulations onto the copy sheets from duplex buffer tray 60 and outputted as completed duplex copy sets. When the tray 60 is depleted the documents are inverted again and the above-described cycles are repeated until the desired number of copy sets are completed.

A compatible duplex/simplex copying system is taught in the Hamlin et al. U.S. Pat. No. 4,229,101. The duplex documents are always copied onto only one side of only clean copy sheets from trays 46 or 47. The simplex copies of one side of the duplex documents are placed in duplex tray 60, and then may be fed out through the normal duplex copying path 62, but without being imaged on their other sides, and being fed alternately (interleaved) with simplex copies made of the other sides of the documents from trays 46 or 47.

In the system here, no copier 10 hardware changes are required. Improved speed but fully compatible precollation copying may be provided with these same basic above-described copying systems at the same imaging station merely by applying a partially different selectable software program to the controller 100 to provide a different process of separating and/or finishing selected copies of document pages from the same RDH 20 here enabling "shared" or common recirculation of two or more document sets to provide more efficient copying.

In a copier using a precollation copying recirculating document handler (RDH) a job containing, for example, only two, three or four original sheets suffers a cumulative thruput loss because the first document sheet does not have enough time to be returned to the document stack, restack, and then be refed to the platen for copying, without skipping copying pitches in each circulation. Further, when duplex copies are being made, as described above, if the number of documents in a set is less than the number of copier copy path pitches used in making duplex copies, then pitch times are wasted in each document set circulation for that reason. The RDH must pause and wait out these copy recirculation pitches and then restart in each circulation.

It has been discovered that it is possible to provide enough documents to fill the pitches without destroying collated output. There is disclosed herein a system of contiguously circulating two or more small document sets in an RDH to substantially increase productivity, i.e. to overcome the frequent problem of small document set copying productivity on longer copying runs, yet still providing collated copy set finishing. The additional document set(s) so commonly recirculated may be "make up" copy sets used as additional RDH document sets.

That is, small set productivity problems are overcome here by commonly recrculating plural different small document sets but separately finishing the copy sets made of each said separate document set. The plural different document sets can be, but do not have to be, the original sets and one or two copies thereof.

As one specific disclosed system herein, when the RDH set counter and the controller detect that a small, e.g. less than four sheet, document set was loaded, by the count obtained at the end of a normal first RDH circulation, and the controller concurrently had been programmed with an operator selection of a large (e.g. more than 5) number of copies, then the operator is automatically instructed via a display on the copier display panel to place the first copy set in the RDH document tray on top of the original document set. The RDH is preferably automatically temporarily stopped by the controller in response to said inputs after this first copy set is made for to be so loaded in the RDH, and the RDH is then restarted thereafter. Alternatively, the operator can press a "Small Set" button and advance. In either case the copier then automatically programs a special output or finishing code. That is, the controller logic will then "bypass" the normal document set separator/counter control system so that the copy compiler and offset stacker and/or stapler will still operate properly for each copy set in this special case. I.e. even though the set separator only activates after recirculating two document sets, because there are now effectively two small document sets in the RDH combined into one set, the compiler and finisher now operate twice per each combined document set circulation.

Heretofore system productivity has been limited by the minimum efficient set size in the document handler. The system herein eliminates this constraint by a relatively simple method which requires no additional hardware.

To explain this by way of further examples of a generalized, flexibly programmable, system, assume that the RDH has a minimum set size of 4 sheets to maintain continuous copying recirculation, so that there will be a significant productivity loss if the exemplary document set contains only three sheets. One solution is for the operator (or the copier automatically as described above) to make a first or "make ready" unfinished copy set of this three sheet original set and then place this copy set on top of the original set in the RDH tray as shown in the FIGURE. This copy set loading may be done automatically as described in the above-cited U.S. Pat. No. 4,391,504 by T. Acquaviva. The operator programs the job by selecting on the copier controller console, in response to automatically sequentially displayed queries:

the number of copies desired
the number of document sets in the RDH (=2 here)
the number of sheets in the first set (=3 here)
the number of sheets in the second set (=3 here)

As the job is running, the finisher ignores the conventional RDH set separator signal as an indication of when to staple, but instead staples each time after only three sheets are placed in the output compiler in this example (except for the first set, used as a document set). These finished sets may be delivered to the output stacker in a non-offset condition. In this manner, the RDH is continuously recirculating six originals, without any skipped pitches, and the system is running at full productivity.

Another example is to commonly load and recirculate small *unrelated* original document sets (plural different jobs) in the document tray. For example, two different three-sheet sets. That job would be run the same as the above example, except that the output stacker could offset the finished sets for easy access and separation by the operator of the two different jobs.

As a further example, an operator faced with multiple jobs may even load several different size jobs in the RDH, as long as they require the same number of copy sets. For example, if the operator has the following three different jobs, all requiring copy sets, the controller console program could be as follows: [Simply punching in the proper number in response to each query. This query sequence is initiated automatically by pressing a "plural job" selection].

the number of copies=9
the number of sets in RDH=3
the number of sheets in the first set=7 (loaded first, in the bottom of tray)
the number of sheets in the second set=3
the number of sheets in the third set=10

The finisher would staple and eject after it receives 7 sheets, 3 sheets, and 10 sheets, and then repeat this sequence for each circulation of all 20 of the documents in the RDH until nine copies are made of all three sets, i.e. nine times.

The time saved by loading and running several jobs simultaneously can be significant. In addition to the savings in not skipping machine pitches in each RDH circulation described above, there is additional time saved by not waiting for the machine to cycle in and cycle out, and the savings in not having to wait for the first copy out time for each set, as compared to separate runs for each set.

Special page programming within each set can also be done, i.e. pages may be directed to be copied "copy dark" or "copy light". Likewise separate set programming may be provided, e.g. selected sets may be stapled, left unstapled or glued.

An additional feature may also be provided by an operator selectable switch control on the controller 100 display console of the copier. This feature also will provide additional plural copy sets from what would otherwise be, individual copy sheet sets, by cutting the normal copy sheets into smaller copy sheets (preferably individually as they are made, or as they are compiled). Cutting in the direction of copy sheet movement can be provided by conventional paper slitter knives individually solenoid activated into the paper path (for example, between roller nips of the output transport). Transverse cutting may be provided by on-line cutters or choppers such as described in U.S. Pat. No. 3,882,744 issued May 13, 1975 and its references. By edge binding, e.g. edge glueing, plural small multiple sheet forms or pads may be produced in this manner. By also providing selectable on-line coating of various of the copy sheets backsides as they are exited (after the fusing step) with conventional carbon-paper-less microencapsulated pressure released inks, multi-part forms can be made on a xerographic copier. If different colored copy sheets are loaded in the different copy sheet input trays these forms can be multi-colored also. Two or more collated copy sets can be produced for each document set circulation or feeding by using so-called "two-up" copying in which more than one document page is copied simultaneously onto each copy sheet. For example, two small or optically reduced document pages at a time may be copied onto single copy sheets. Then these 2-image-per-side copy sheets may be recirculated in the RDH to make collated copy sets therefrom, wherein each copy sheet also has the same two images per side. Then by activating an above-described on-line paper slitter the copy sheets may be centrally cut apart to separate the two images into two separate copy sheets, for separate binding of these accumulated plural small copy sheets with each circulation of this dual-image document sheet set.

The above examples assume the same number of copies are made from all of the documents. However, an additional feature can be to provide console switch programming of different respective numbers of copies for the different commonly recirculated document sets. Productivity in this mode can be increased further by ejecting the documents whose copying is completed, e.g. in the SADH document output path as shown in said U.S. Pat. No. 4,391,504 and continuing recirculation only of the documents requiring additional copies, rather than slewing (skip copying recirculating) those documents having less copies made thereof.

While the embodiments disclosed herein are preferred, it will be appreciated that they are merely examples, and that various alternatives, modifications, variations or improvements thereon may be made by those skilled in the art from this teaching, which are intended to be encompassed by the following claims.

What is claimed is:

1. A method of more efficiently copying document pages with a copier with a recirculating document handler for making plural precollated plural sheet copy sets from a plural page set of plural document sheets plurally recirculated from the document handler to the imaging station of the copier and back, with controlling said copying by counting the number of document sheets being recirculated and normally controlling the output of said precollated copy sets in separated said sets each containing numbers of copy sheets corresponding to said number of document sheets in said set; the improvement comprising recirculating a set of document sheets having at least two document page images per document sheet side to produce copy sheets with at least two page images per side from said document sheets, and modifying said copying controlling to separate said copy sheets into at least two separate sub-sets of output copy sets, the number of said sub-sets being at least twice the number of document sheets being recirculated in said document handler, and separately binding said output copy sets into said separated collated sub-sets in response to said copier control modification with automatic on-line binding means actuated to separately bind said copy sub-sets.

2. The method of claim 1 including the known step of conventional on-line paper slitting or cutting of the copy sheets, for separating said copy sheets into said separate sub-sets.

* * * * *